United States Patent [19]

Johnson

[11] 3,991,829

[45] Nov. 16, 1976

[54] DELAYED CLOSING FIRE SPRINKLER HEADS

[75] Inventor: Wilfred V. Johnson, Oxford, Mass.

[73] Assignee: U. S. Fire Control Corporation, Oxford, Mass.

[22] Filed: Oct. 14, 1975

[21] Appl. No.: 621,859

Related U.S. Application Data

[60] Division of Ser. No. 399,851, Sept. 24, 1973, Pat. No. 3,911,940, which is a continuation-in-part of Ser. No. 143,394, May 14, 1971, Pat. No. 3,802,510.

[52] U.S. Cl. ..... 169/19; 137/79; 236/99 K; 251/74

[51] Int. Cl.[2] ..... A62C 37/06

[58] Field of Search ..... 169/19, 37, 26; 236/93, 236/99 D, 99 I, 99 K; 137/79; 251/74, 302

[56] References Cited

UNITED STATES PATENTS

| | | | |
|---|---|---|---|
| 1,143,762 | 6/1915 | Hooks | 169/37 |
| 1,884,794 | 10/1932 | McKee | 236/99 I |
| 2,230,179 | 1/1941 | Cid | 169/37 |

*Primary Examiner*—John J. Love
*Assistant Examiner*—Michael Mar
*Attorney, Agent, or Firm*—John E. Toupal

[57] ABSTRACT

A fire sprinkler valve with a valve member coupled to a primary temperature responsive control mechanism that is activated to open the valve in response to ambient temperatures above a given temperature level and that urges the valve toward closed position in response to temperatures below that level. An auxiliary control causes automatic reclosure of the valve only in response to a decrease in an ambient temperature to below the given level.

6 Claims, 7 Drawing Figures

DELAYED CLOSING FIRE SPRINKLER HEADS

CROSS-REFERENCE TO RELATED APPLICATION

This application is a division of U.S. Application Ser. No. 399,851, filed Sept. 24, 1973, and entitled "Delayed Closing Fire Sprinkler Heads" now U.S. Pat. No. 3,911,940 which was in turn a continuation-in-part of U.S. Application Ser. No. 143,394, filed May 14, 1971, and entitled "Automatic Fire Sprinkler Head" which issued on Apr. 9, 1974, as U.S. Pat. No. 3,802,510.

BACKGROUND OF THE INVENTION

This invention relates generally to valves and, more particularly, to automatically opening and closing temperature responsive valves for use in fire extinguishing systems.

Automatic fire extinguishing systems are useful for quickly extinguishing or controlling fires. The general acceptance of such systems is evidenced by their extensive use in commercial buildings such as factories, office buildings, apartment houses, stores, etc. In addition, their use has expanded recently for the protection of homes in residential areas. Conventional systems usually include a plurality of individual valve and nozzle combinations, with each valve independently controlled by a thermally fusible element. With independently controlled valves only those nozzles subject to heat produced by a fire are activated, rather than the entire system. Therefore, water damage does not occur in areas remote from the fire. Conventional fire valves, however, being of the "one-shot" type do not automatically close and reset so that water continues to flow after a fire is extinguished unless the water supply to the building is manually shut off. For this reason, water is wasted, and unnecessary water damage in the area of the fire results. A typical example would be a grease fire confined to a single pan and quickly extinguished by merely placing a cover over the pan. If, however, a "one-shot" fire valve in the kitchen had been activated by the heat generated before extinguishment, water would continue to flow needlessly until the water supply was turned off at the source.

Valves that automatically close and reset upon cooling have been proposed to alleviate the problems discussed above. However, one problem associated with many such valves stems from their sensitivity to a given critical actuation temperature. Because of this sensitivity the valve can in some cases rapidly cycle between open and closed positions in response to temperature fluctuating around the critical actuation temperature. Such rapid cycling can be disadvantageous in certain applications in which a longer or more predictable on-time is desired.

The object of this invention, therefore, is to provide an on-off fire sprinkler valve in which on-time is controlled to provide greater predictability of operation.

SUMMARY OF THE INVENTION

One feature of the invention is the utilization of a primary temperature responsive control mechanism comprising a body of expansible fusible crystalline material. This material is characterized by a sharply defined melting point and a substantial increase in volume during the solid-to-liquid transition. The change in volume is used to mechanically control the valve member which is small in size and quickly and fully open when the ambient temperature reaches the melting point. Subsequently, as the ambient temperature declines, a substantial volume decrease occurs in the expansible material during a liquid-to-solid transition. The valve is then closed by a bias spring that opposes the expansion-induced opening. Thus, the flow of water is automatically stopped after the fire is extinguished, and the valve can be recycled at any time.

One embodiment of the invention employs an auxiliary control that moves a thermal shield over the melted material upon opening of the valve. The shield functions to retard cooling of the material and thereby delay reclosing of the valve.

Another embodiment of the invention includes as an auxiliary control a second temperature responsive actuator that allows the valve to open but prevents its closure with ambient temperature above a certain level. The second actuator responds to a lower temperature than the primary actuator and therefore provides a temperature delay for reclosure that insures full extinguishment of the fire.

DESCRIPTION OF THE DRAWINGS

These and other features and objects of the invention will become more apparent upon a perusal of the following description taken in conjunction with the accompanying drawings wherein.

DESCRIPTION OF THE PREFERRED EMBODIMENTS

Figure 1:
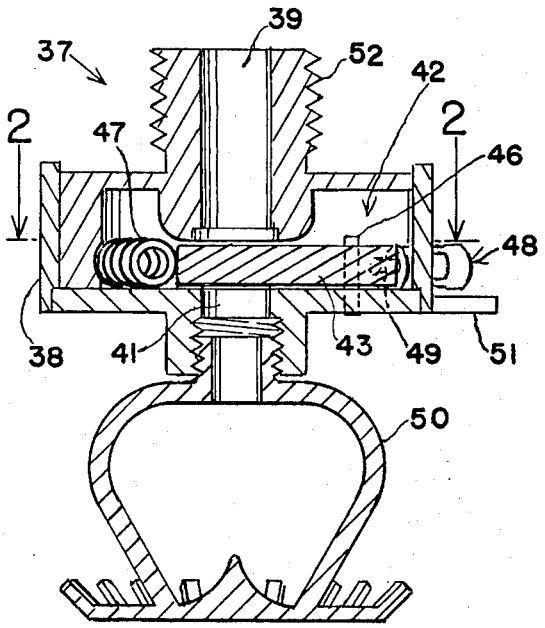
FIG. 1 is a sectional view of one preferred embodiment of the invention.
Figure 2:
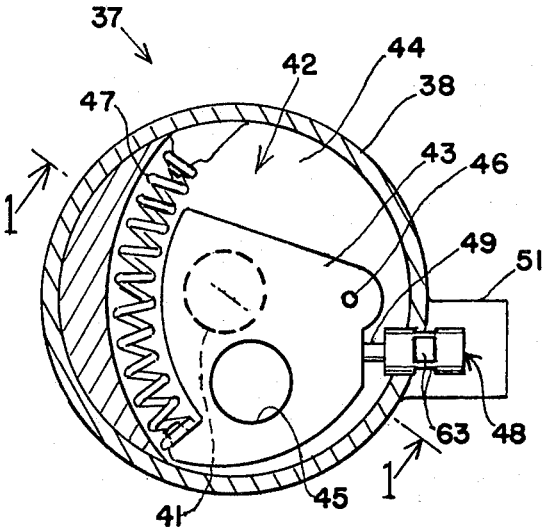
FIG. 2 is a sectional plan view of the embodiment shown in FIG. 2 taken along the lines 2—2.

Referring now to FIGS. 1 and 2 there is shown a valve embodiment 37 of the invention including a housing 38 defining an inlet opening 39 and an outlet opening 41. Within the housing 38 is a cavity 42 with an eccentric cam 43 resting on a lower surface 44 thereof. The eccentric cam 43 defines a valve opening 45 and is pivotally mounted by a pin 46. A bias spring 47 holds the cam 43 in a closed position, that is, with the valve opening 45 horizontally displaced from the outlet 41. Mounted on the housing 38 is a temperature responsive control mechanism 48 that is operatively coupled to the cam 43 by a reciprocating actuator 49. The cam 43 mechanically couples the spring 47 to the actuator 49 as a lever, thereby amplifying the force exerted by the spring 47 on the actuator 49. Disposed below the control mechanism 48 is a deflector 51 to prevent the cooling of the control mechanism by splashing water discharged against a dispensing deflector 50 located below the outlet 41. An upper portion 52 of housing 38 is threaded so that the unit 37 may be easily substituted for conventional fusible type nozzles in existing fire extinguishing systems.

Figure 3:
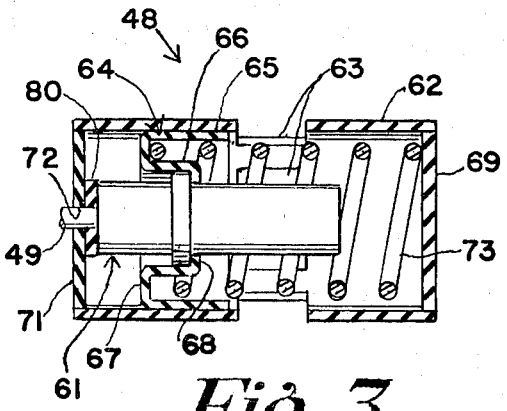
FIG. 3 is a detailed view of the control mechanism with the valve of FIGS. 1 and 2 in closed position.
Figure 4:
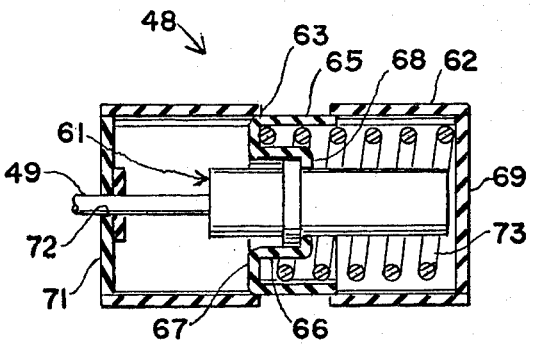
FIG. 4 is a detailed view of the control mechanism with the valve of FIGS. 1 and 2 in an open position.

Referring now to FIGS. 3 and 4, there are shown detailed views of the control mechanism 48 shown in FIGS. 1 and 2. A primary control mechanism 61 is retained by a cylindrical casing 62. Within the temperature responsive control mechanism 61 is a body of expansible material that exhibits a substantial volume change during the liquid-to-solid transition. The melting point can be selected accurately from a wide temperature range by varying the composition of the material. Suitable mechanisms of this type are disclosed, for example, in U.S. Pat. Nos. 2,815,174; 2,938,384; and 3,092,322. Changes in volumes of the material within the mechanism 61 produce reciprocating mechanical motion of the operatively coupled actuator 49.

The casing 62 possesses a plurality of openings 63 that provide air circulation to the mechanism 61. Within the casing 62 is an annular cup 64 with spaced apart outer and inner walls 65 and 66 joined at one end by an end wall 67. An inwardly directed upper flange 68 terminates the opposite end of the inner wall 66 and engages an annular ridge extending from the mechanism 61. The outer wall 65 is adapted for axial sliding movement along the inner surface of the casing 62 which is closed at one end by an end wall 69. Additional support for the mechanism 61 is provided by an opposite end wall 71 having a central aperture 72 that accommodates the actuator rod 49. An insulator ring 80 is disposed around the aperture 72 on the inner surface of the end wall 71. A coiled spring member 73 is compressed between the end wall 69 and the end wall 67. As described hereinafter, the spring member 73 and cup 64 together form an auxiliary control means for delaying the closure of the valve 37 in response to decreasing ambient temperatures occurring subsequently to a previous rise in temperature that induced operation of the primary control mechanism 61.

During operation of embodiment 37 the bias spring 47 normally holds the eccentric cam 43 in the closed position. Heat, caused by a fire, raises the ambient temperature and, therefore, the temperature of the primary control mechanism 61 until the melting point of the expansible material is reached. This occurs quickly since the mechanism 61 is not thermally shielded by the insulator cup 64. As the expansible material melts, the associated increase of volume urges the actuator 49 to the left as viewed in FIGS. 2 and 3 overcoming the bias of the spring 47. This motion of the actuator rotates the eccentric cam 43 clockwise to the open position that is disposed with the valve opening 45 disposed between the inlet 39 and the outlet 41. Water then flows through the valve 37. With the valve fully opened, further motion of the actuator 49 is restrained by the compressed spring 47. Additional expansion of the melted material causes the mechanism 61 and cup 64 to move toward the right compressing the heavier spring 73 and moving the outer wall 65 over the openings 63 as shown in FIG. 4. In this way the mechanism is thermally shielded from the environment surrounding the casing 62.

When the fire is extinguished and the temperature of the mechanism 61 decreases below its given melting point, the body of expansible material solidifies with an associated decrease in volume. However, this cooling action is retarded by the outer wall 65 of the cup 64 which has covered the openings 63 to thereby thermally shield the mechanism 61 from the surrounding environment. When the decrease in volume does occur, the bias spring 47 through the lever action of the cam 43 forces the actuator 49 to the right as viewed in FIG. 3. The valve 37 is then closed and ready to be recycled upon another increase in temperature. Thus, the auxiliary control members 64 and 73 delay closure of the valve.

Figure 5:
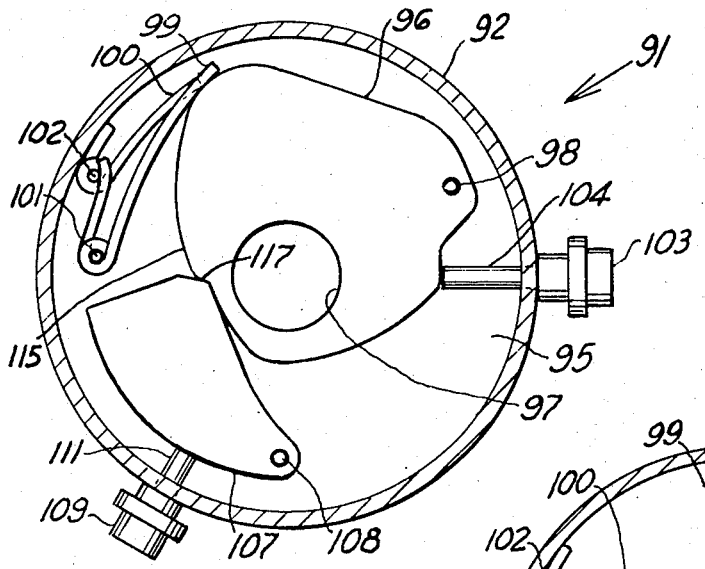
FIGS. 5 and 6 show another preferred embodiment with the valve in open and closed positions, respectively.
Figure 6:
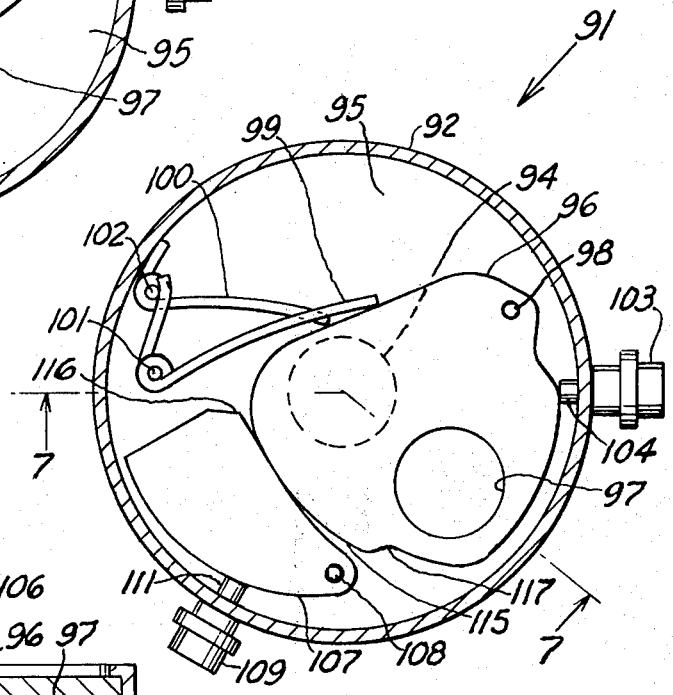
Figure 7:
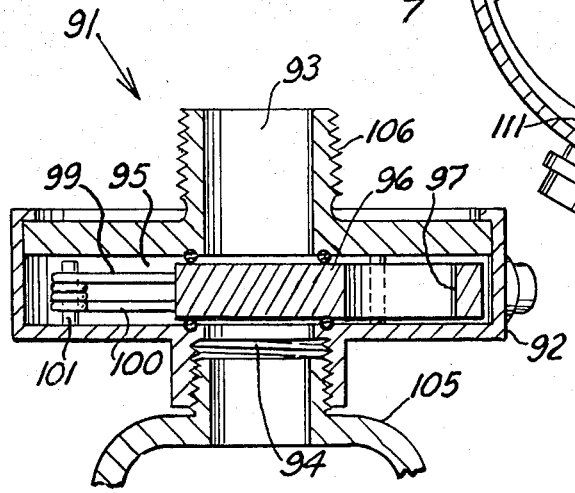
FIG. 7 is a sectional view of the embodiment shown in FIG. 6 and taken along lines 7—7.

Referring now to FIGS. 5–7, there is shown another embodiment 91 again including a housing 92 with an inlet opening 93 and an outlet opening 94. Within the housing 92 is a cavity 95 retaining an eccentric cam 96 similar to the cam 43 shown in FIG. 3. The cam 96 defines a valve opening 97 and is pivotally mounted on a pin 98. A bias leaf spring 99, mounted on pins 101 and 102, urges the cam 96 toward closed position shown in FIG. 6 that is with the valve opening 97 horizontally displaced from the outlet 94. An auxiliary helper spring 100, also mounted on pin 102, also engages the cam 96 and further biases the opening 97 toward closed position. Mounted on the housing 92 is a primary temperature responsive control mechanism of the type previously described and coupled to the cam 96 by a reciprocable actuator 104. Mounted below the housing 92 is a deflector 105 for dispersing fluid discharged through the outlet 94 while an upper portion 106 of the housing 92 is threaded to facilitate assembly into a fire extinguishing medium supply system.

The temperature responsive mechanism 103, the cam 96 and the bias springs 99 and 100 function in the same manner as embodiment 37 to provide automatic control of extinguishing medium discharge in response to ambient temperature. However, even more selective control is made possible by a latching cam 107 freely mounted for rotation in the cavity 95 on a pin 108. An auxiliary temperature responsive mechanism 109 is mounted on the housing 92 and has a reciprocable piston 111 that engages the cam 107. Again, the mechanism 109 is preferably a wax filled element of the type described above.

The mechanism 109 is selected for response to an ambient temperature below that required to actuate the mechanism 103. For example, the wax in mechanism 109 would melt at an ambient temperature of about 140° F while the wax in mechanism 103 would melt at an ambient temperature of about 180° F. Thus, in response to rising ambient temperature accompanying a fire the wax in mechanism 109 will first melt forcing the piston 111 against the locking cam 107 which is restrained by engagement with the cam 96. Preferably only the final portion of the piston's outward stroke is utilized so as to limit the internal pressure within the mechanism 109 that is restrained. A further rise in ambient temperature activates the mechanism 103 producing outward movement of the actuator 104 and urging the cam 96 toward the open position shown in FIG. 5. Fire extinguishing fluid discharge through the outlet 94 is thereby initiated. During opening movement of the cam 96 its surface 115 moves across the engaging apex 116 on auxiliary cam 107 which initially remains stationary. However, when the relative positions shown in FIG. 5 are reached, the auxiliary cam 107 is moved by the previously activated piston 111 forcing the apex 116 into a recess 117 formed in the surface 115. This engagement between the apex 116 and the recess 117 latches the cam 96 in the open position. Thus, a reduction in ambient temperature to below the 180° F setting of the mechanism 103 will not result in closure of the valve unless a further drop to below the 140° F setting of the mechanism occurs. At that temperature, the wax in the mechanism 109 solidifies and contracts relieving the force exerted on the auxiliary cam 107 by the piston 111. This in turn allows the bias springs 99 and 100 to pivot the cam 96 into closed position after first forcing the apex 116 out of the recess 117. The thermal delay provided by the latching cam 107 enhances the probability that a fire is extinguished before valve closing is effected, thus the possibility of rekindling that might produce cycling of the valve between open and closed positions is reduced. Another desirable feature of the embodiment 91 is the leaf spring 99 which is engaged at a position nearer to its heel 119 with the cam 96 in a closed position (FIG. 6) than in an open position (FIG. 7). For this reason, the spring 99 exerts a variable force on the cam 96 that is greater in the closed position than in the open position. This is desirable because as described above the force required to fully move the piston into the mechanism 103 is greatest during the final portion of the inward stroke. The helper spring 100 compensates for this action of the spring 99 by exerting maximum force with the cam 96 in the open position shown in FIG. 5 thereby insuring initial closure movement.

Obviously, many modifications and variations of the present invention are possible in light of the above teachings. For example, features shown in the individual embodiments can be interchanged as desired. It is to be understood, therefore, that the invention can be practiced otherwise than as specifically described.

What is claimed is:

1. A valve assembly for use in automatic fire extinguishing systems and comprising:

a housing means defining inlet and outlet openings;

a valve member movable between closed and open positions, said valve member preventing fluid flow between said inlet and outlet openings when in said closed position and permitting the discharge of fluid available at said inlet opening through said outlet opening when in said open position;

actuator means for moving said valve member between said open and closed positions;

primary temperature responsive control means operatively coupled to said actuator means for automatically effecting movement of said valve member to said open position in response to ambient temperatures above a given level; and auxiliary temperature responsive control means operatively coupled to said actuator means and operative to automatically effect movement of said valve member to said closed position in response to an ambient temperature below said given level occurring subsequently to opening of said valve member by said primary control means.

2. A valve assembly according to claim 2 wherein said primary temperature responsive control means comprises a primary mechanism that experiences a mechanical deformation when subjected to temperatures above said given level, and said auxiliary temperature responsive control means comprises an auxiliary mechanism that experiences a mechanical deformation when subjected to temperature above a second level less than said given level.

3. A valve assembly according to claim 2 wherein said primary mechanism experiences reversible deformations when subjected to temperatures above or below said given level, and said auxiliary mechanism experiences reversible deformations when subjected to temperatures above or below said second level.

4. A valve assembly according to claim 3 wherein each of said primary and auxiliary mechanisms comprise bodies of expansible material of a type that experiences substantial volume changes between solid and liquid states, said changes of state being induced by changes in temperature.

5. A valve assembly according to claim 2 wherein said auxiliary temperature responsive control means comprises latching means responsive to said auxiliary mechanism for latching said valve member in said open position at ambient temperature above said second level.

6. A valve assembly according to claim 5 wherein said primary temperature responsive control means comprises biasing means opposing movement of said valve member to said open position.

* * * * *